United States Patent [19]

Barnes

[11] 4,290,603

[45] Sep. 22, 1981

[54] BALL EJECTING GOLF CUP

[76] Inventor: Howard H. Barnes, Box 14, Missouri City, Tex. 77459

[21] Appl. No.: 157,217

[22] Filed: Jun. 9, 1980

[51] Int. Cl.[3] ..... A63B 57/00

[52] U.S. Cl. ..... 273/34 A; 273/DIG. 25

[58] Field of Search ..... 273/34 A, 179, 180, 273/DIG. 25

[56] References Cited

U.S. PATENT DOCUMENTS 3,036,834 5/1962 Zalkind ..... 273/DIG. 25

3,792,861 2/1974 Coleman ..... 273/34 A

*Primary Examiner*—George J. Marlo

*Attorney, Agent, or Firm*—John A. Hamilton

[57] ABSTRACT

A ball ejecting golf cup in which a golf ball comes to rest; on a vertical plunger disposed within the cup to traverse a sealed chamber, the plunger being spring-biased in an upward direction, the ball and plunger being depressible by the golfer with any suitable tool, such as the handle of his putter, with no requirement that he lean or stoop, and a device for retaining the plunger depressed for a short time, allowing the putter to be removed, and then to release the plunger to snap upwardly to eject the ball upwardly to a height convenient for the golfer to catch it. Mechanism is provided for adjusting both the time delay before the ball is ejected, and also the height to which the ball is ejected.

4 Claims, 4 Drawing Figures

BALL EJECTING GOLF CUP

This invention relates to new and useful improvements in golf cups, and has as its overall object the provision of a golf cup operable to eject a golf ball entering it to a height such that the golfer may conveniently catch it without leaning or stooping. Many golfers are afflicted with physical infirmities and problems which render such leaning or stooping difficult or painful, and also embarrassing to the golfer if observed by others.

Another object is the provision of a golf cup of the character described in which the ejection of the ball is not automatic, but requires a positive, easily observable action by the golfer, whereby to eliminate any possible doubt that the ball has actually entered the cup. If the ball were automatically ejected, such doubts could easily arise if an observer were not watching closely at the proper moment. This positive action may be to press the ball downwardly in the cup with the putter handle, an action which can be performed without appreciable leaning or stooping.

A further object is the provision of a golf cup of the character described including means whereby a time delay is introduced between the time the ball is pressed down and the time the ball is ejected, in order to give the golfer time to remove the putter before the ball is ejected. This delay should be perhaps a second or two, but may be adjusted as desired.

A still further object is the provision of a golf cup of the character described including means for adjusting the height to which the ball is thrown when ejected. A height about belt-high to the golfer is generally considered desirable.

Other objects are simplicity and economy of construction, and efficiency and dependability of operation.

Figure 1:
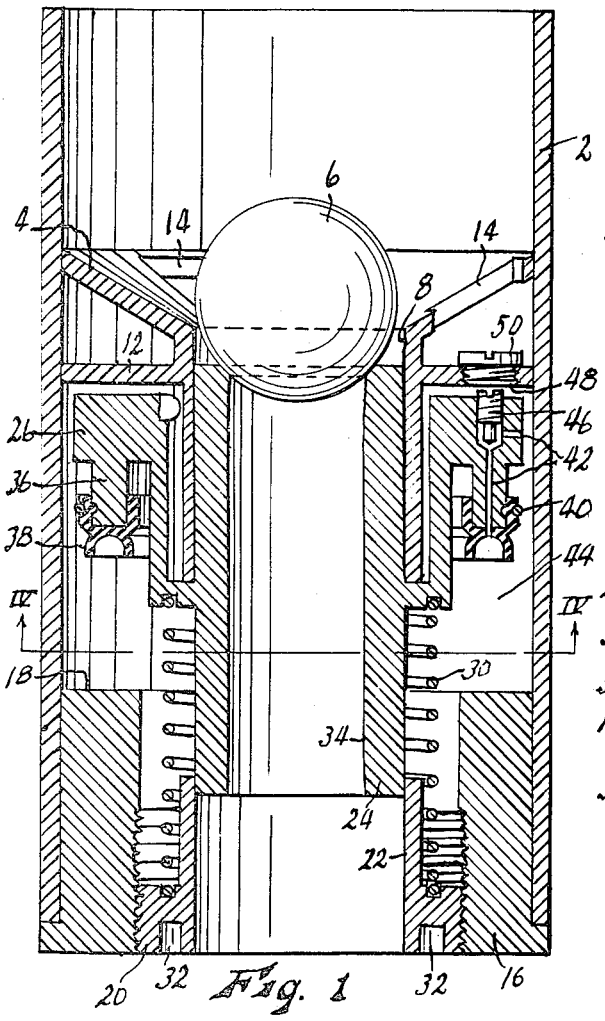
Figure 2:
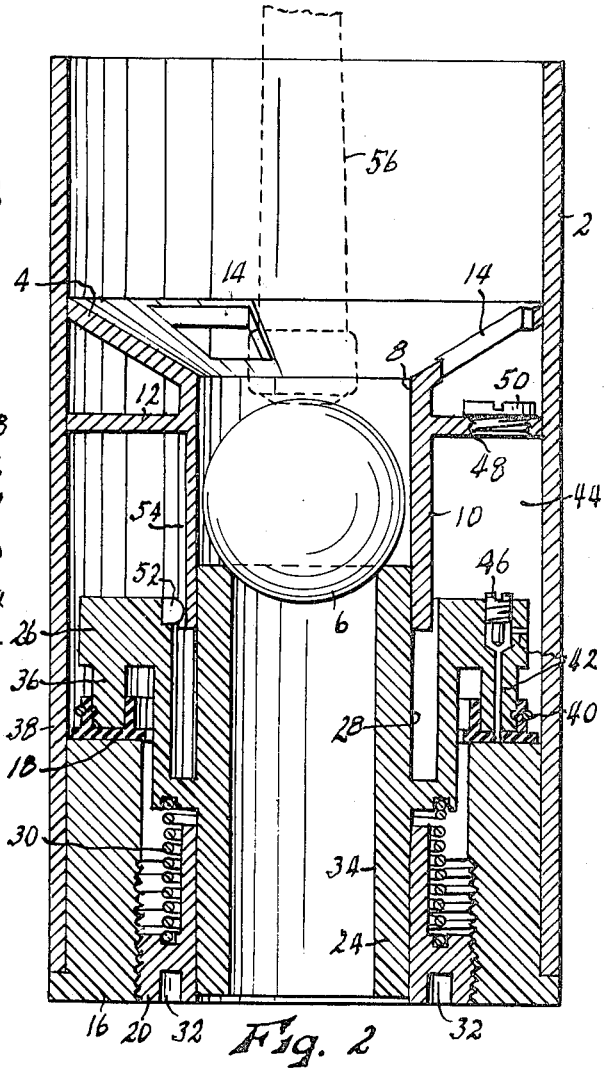
Figure 3:
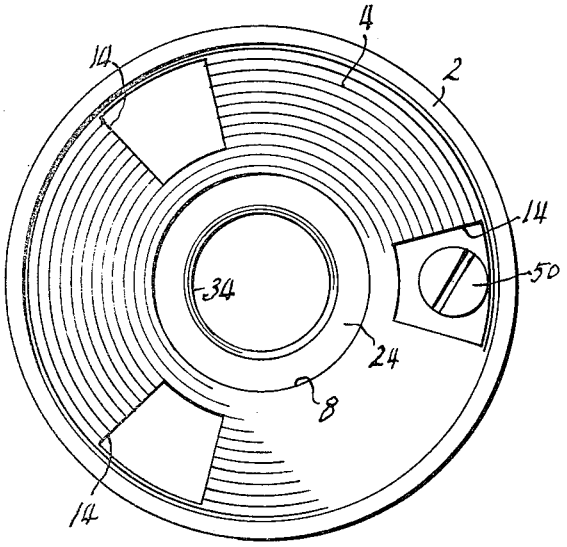
Figure 4:
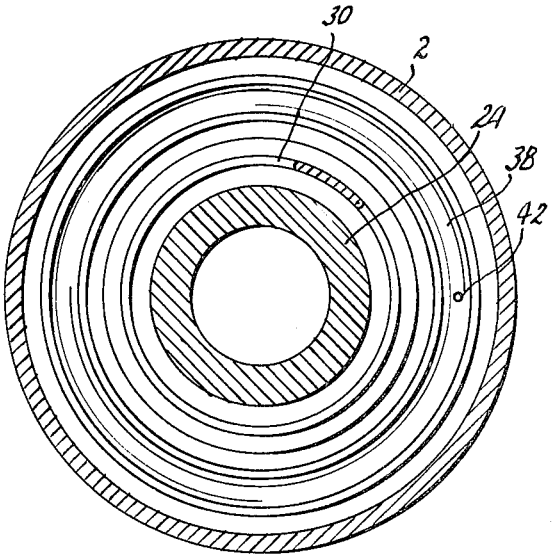

With these objects in view, as well as other objects which will appear in the course of the specification, reference will be had to the accompanying drawings, wherein:

FIG. 1 is a vertical sectional view of a golf cup embodying the present invention, showing a golf ball resting normally therein, FIG. 2 is a view similar to FIG. 1, but showing the position of the parts after the ejecting plunger has been depressed, FIG. 3 is a top plan view of the cup, with the ball omitted, and FIG. 4 is a sectional view taken on line IV—IV of FIG. 1.

Like reference numerals apply to similar parts throughout the several views, and the numeral 2 applies to the body member of the cup. Said body member constitutes a hollow cylinder formed of metal, plastic or any other suitable structural material, adapted to be mounted in the earth of a golf green with its axis disposed vertically and its open upper end flush with the ground surface. At the proper distance below the top of the body member, it is provided with a frusto-conical floor member 4. Said floor diverges upwardly, concentrically with the body member, and its function is to center a golf ball 6 falling into the cup relative to the cup. It is provided at its lower end with a central orifice 8 having a diameter slightly greater than that of a golf ball, in order that a ball may pass freely therethrough, and a depending coaxial tube 10 of the same internal diameter as the orifice. Just below floor 4 is a flat annular top wall 12, normal to the body axis, sealing the annular space between tube 10 and body 4. Floor 4, tube 10 and top wall 12 may be formed integrally, and are welded, cemented, or otherwise rigidly affixed in the body member. Floor 4 has three circumferentially spaced holes 14 formed therethrough. These holes are not large enough to pass a golf ball, but are extractor holes, providing means whereby the cup may be engaged by a suitable extractor tool, not shown, for pulling it from the ground, as is done in the process of changing the pin placement on a green.

An annular plug 16 is rigidly affixed in the lower end of body member 2, its upper end surface 18 forming an anvil for cooperation with a suction cup, as will be described, this surface being normal to the body axis and spaced well below top wall 12. Plug 16 is internally threaded, and has an annular spring retainer 20 screwed therein. Said retainer has an upwardly extending tubular extension 22 coaxial with and having the same internal diameter as tube 10, though spaced well below tube 10.

Carried for vertical sliding movement within tubes 10 and 22 is a plunger tube 24, said plunger being of such length that it is engaged and guided in both tubes at all times. Said plunger is provided with an annular portion 26 disposed outside of tube 10, having an annular recess 28 formed concentrically in its top surface for receiving tube 10. Upward movement of the plunger is limited by the engagement of the lower end of tube 10 with the base of said recess. The plunger is biased upwardly at all times by a helical compression spring 30 coaxial with the body member and encircling plunger tube 24, being based at its upper end on an outward projection of the plunger, and at its lower end against retainer 20. The spring tension, and hence the force with which the plunger is urged upwardly, may be adjusted by screwing said retainer up or down in plug 16, and the retainer may be provided with pin wrench sockets 32 for this purpose. The internal bore 34 of plunger tube 24 opens through both ends of said tube, and while too small to admit a golf ball, is large enough to allow the insertion of the staff of a flag such as is commonly used to mark the location of the cup on a green.

The portion 26 of the plunger outside of tube 10 is provided with a short, depending, cylindrical and coaxial wall 36, which carries a downwardly opening annular suction cup 38, said suction cup having its upper portion configurated to engage snugly over the lower edge portion of said wall, said suction cup being firmly anchored to said wall by a wire retainer loop 40. It is adapted to be moved into engaging relation with anvil surface 18 of plug 16 by downward movement of the plunger, as shown in FIG. 2. A small air passage 42 extends from the interior of the suction cup through plunger wall 36 into the body chamber 44 between plug 16 and top wall 12. This passage is regulatable by a needle valve 46 threaded into the top of plunger section 26. It may be adjusted by an ordinary screwdriver, for which access from the ground surface is provided by an aperture 48 formed in top wall 12, which is normally closed by a screw plug 50, and one of extractor holes 14 of floor 4. In order to maintain valve 46 aligned at all times with aperture 48 and the associated extractor hole, the plunger is provided with a key 52 movable slidably in a keyway 54 formed in the exterior surface of tube 10.

In operation, it will be seen that the parts normally have the positions shown in FIG. 1, with plunger 24 held in its upper position by spring 30. When a golf ball 6 falls into the cup, it is centered by floor 4 and comes to rest supported on the upper end of the plunger, within tube 10, also as shown in FIG. 1. The golfer then reverses his putter 56, and presses down on the ball with the putter handle, as shown in FIG. 2. Other tools may be used for this purpose, but a putter is always at hand. The ball, and thus plunger 24, are thus moved downwardly, compressing spring 30, until suction cup 38 operatively engages anvil surface 18 of plug 16 to retain the plunger in its depressed position, against the bias of spring 30, to allow the golfer time to remove his putter. Immediately, air begins to enter the interior of the suction cup through passage 42 and valve 46, and after a predetermined time lapse to allow the golfer to remove his putter, the entering air will release the suction cup to allow the plunger to be snapped upwardly by spring 30. The time delay for this purpose need only be a second or two, but it may be adjusted by turning valve 46 to restrict the flow of air in passage 42 to a greater or lesser extent. Due to the very rapid rise of the plunger, it throws the ball upwardly out of the cup to a height at which it may easily be caught by the golfer without leaning or stooping, said about belt-high. The height to which the ball is thrown may be adjusted by turning spring retainer 20 to vary the tension of spring 30.

The chamber 44 of the cup body in which the plunger moves is substantially sealed against the entry of dust, dirt, sand, grass clippings and the like, which if allowed to enter could foul the surfaces to inhibit free movement of the plunger. Moreover, even though this chamber if effectively sealed, air pressures or vacuums cannot form therein which would themselves inhibit free movement of the plunger. This is true because all portions of chamber 44 are in open air communication around the plunger, so that movement of the plunger merely moves the air from one portion of the chamber to another, and does not generate pressures or vacuums. There will of course always be ample air within the chamber to release the suction cup, due to the extremely large volume of the former as compared to that of the latter.

While I have shown and described a specific embodiment of my invention, it will be readily apparent that many minor changes of structure and operation could be made without departing from the spirit of the invention.

What I claim as new and desire to protect by Letters Patent is:

1. A golf cup comprising:

a. an open-end body member adapted to be sunk vertically into the turf of a golf green, with its open top substantially flush with the ground surface, b. upper and lower closures mounted in said body member in vertically spaced apart relation to form a chamber therebetween, said upper closure being spaced below the top of said body member whereby to define, with said body member, an open-topped cup into which a golf ball may fall, said closures sealing against said body member and each having a central aperture opening therethrough, the diameter of the aperture of at least the upper closure being greater than that of a golf ball.

c. a plunger closely fitted in the central aperture of said closures for limited vertical sliding movement, and substantially sealing said chamber, d. ejecting means biasing said plunger to the upper limit of its movement, a golf ball dropping into said cup coming to rest on the upper end of said plunger when the latter is at the upper limit of its movement, whereby when said plunger is then manually depressed by downward pressure on said ball and subsequently released, it will be raised rapidly by said ejecting means to throw said ball upwardly from the upper end of said body member, e. retaining means operable to retain said plunger in its depressed position against the pressure of said ejecting means, and constituting a suction cup and anvil surface which may be moved into engaging relation by depression of said plunger, one carried by said plunger and the other by one of the closures of said body member, said suction cup and said anvil being disposed within said substantially sealed chamber of said body member, whereby to prevent the passage of dirt or other foreign material thereto, all portions of said chamber having free air communication around said plunger, whereby no motion-impeding vacuums or pressures are generated by the motion of said plunger, and f. releasing means operable to reduce said retaining means after a pre-determined time lapse from its engagement, and constituting means operable to admit air between said suction cup and said anvil surface.

2. A golf cup as recited in claim 1 wherein said means operable to admit air between said suction cup and said anvil surface constitutes an air passage interconnecting the interior of said suction cup to said sealed chamber of said body member, whereby air for this purpose is also rendered substantially free of foreign matter.

3. A golf cup as recited in claim 2 with the addition of a manually adjustable valve disposed in said air passage and operable to regulate the rate of entry of air between said suction cup and said anvil surface.

4. A golf cup as recited in claim 1 wherein said suction cup and said anvil surface are annular in form, encircling said plunger within said chamber, and wherein said plunger is tubular, opening upwardly to the top of said body member, its internal diameter being smaller than the diameter of a golf ball but sufficiently large to permit the insertion therethrough of the staff of a pin flag in the usual manner.

* * * * *